United States Patent [19]

Frost

[11] 3,959,867

[45] June 1, 1976

[54] METHOD OF MAKING A HEAT EXCHANGER AND THE HEAT EXCHANGER

[75] Inventor: Donald J. Frost, Racine, Wis.

[73] Assignee: Modine Manufacturing Company, Racine, Wis.

[22] Filed: Oct. 15, 1974

[21] Appl. No.: 514,475

[52] U.S. Cl. ..... 29/157.3 AH

[51] Int. Cl.[2] ..... B23P 15/26

[58] Field of Search ..... 29/157.3 AH; 113/1 C; 29/202 R, 157.3 AH

[56] References Cited

UNITED STATES PATENTS

| | | | |
|---|---|---|---|
| 1,584,772 | 5/1926 | Hyde | 29/157.3 AH |
| 2,494,286 | 1/1950 | Collins | 113/1 C X |
| 2,643,863 | 6/1953 | Buschow | 29/157.3 |

*Primary Examiner*—C. W. Lanham
*Assistant Examiner*—V. K. Rising
*Attorney, Agent, or Firm*—Wegner, Stellman, McCord, Wiles & Wood

[57] ABSTRACT

A method of making a heat exchanger having inner and outer first and second conduits spaced apart to define a fluid flow space therebetween in which the conduits are arranged in separated relationship and successive coils of a narrow strip of a fluid agitating turbulator are wound on the outer surface of the first conduit to provide successive coils on this surface and the first and second conduits are telescoped together to define the space and arrange the turbulator therewithin. The disclosure also includes a heat exchanger resulting from the above method.

2 Claims, 2 Drawing Figures

METHOD OF MAKING A HEAT EXCHANGER AND THE HEAT EXCHANGER

BACKGROUND OF THE INVENTION

It is common practice to manufacture heat exchangers for exchanging heat between fluids in which inner and outer tubes are arranged in coaxial relationship to provide a cylindrical space between them which serves as a flow space for one of the fluids and occupied by a fluid agitator or turbulator and to provide fittings at each end of the outer tube for directing a fluid into and out of the space while a second fluid flows through the interior of the inner tube. Heat exchangers of this type are disclosed in Dedo U.S. Pat. No. 2,752,125 assigned to the same assignee as the present application and Straubing U.S. Pat. No. 3,001,767.

The applicant here has discovered that this type of heat exchanger can be made readily, efficiently and at less cost by the method of this invention and the resulting heat exchangers have advantages not achieved by those of the prior art.

SUMMARY OF THE INVENTION

One of the features of this invention therefore is to provide an improved method of making a heat exchanger comprising inner and outer tubular conduits spaced apart to define a fluid flow space therebetween and a turbulator in this space comprising a narrow strip having the form of successive coils of the turbulator.

Another feature of the invention is to provide a heat exchanger having a structure resulting from this method.

DESCRIPTION OF THE PREFERRED EMBODIMENT

Figure 2:
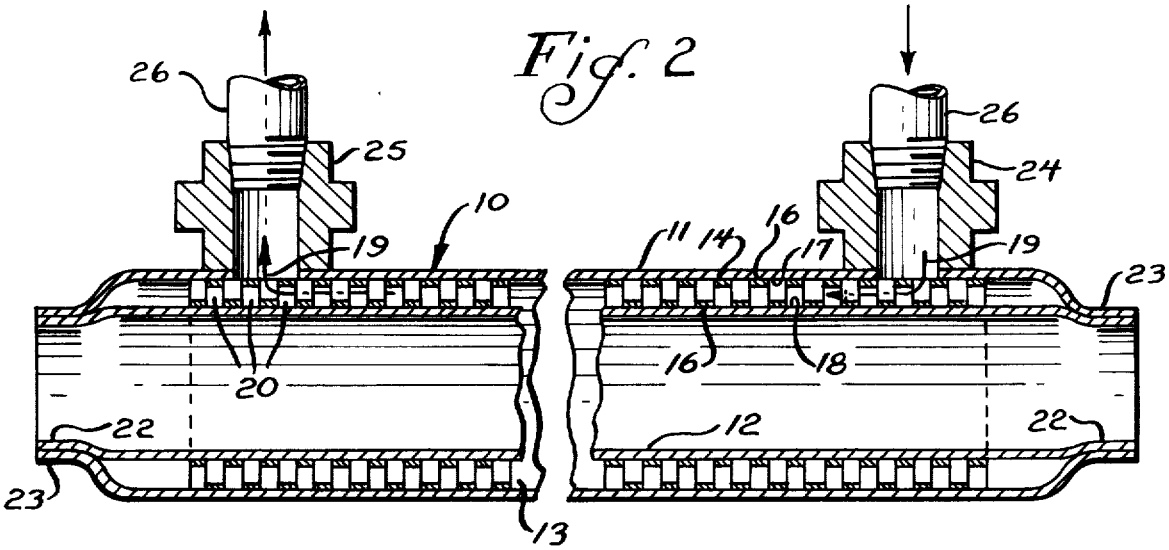
FIG. 2 is a longitudinal view in section and shortened illustrating the heat exchanger of this invention.

As is illustrated in FIG. 2 the heat exchanger 10 comprises an outer cylindrical tube 11, an inner cylindrical tube 12 spaced apart to define a fluid flow space 13 therebetween and a turbulator 14 within this space.

This turbulator is in the form of a strip 15 of expanded metal having offset lateral projections 16, one set of which is in contact with the inner surface 17 of the outer tube 11 and the other set of which is in contact with the outer surface 18 of the inner tube 12. With this arrangement flow of fluid as indicated by the arrows 19 into and out of the space 13 is in turbulent flow for good heat transfer contact with both of the tubes 11 and 12.

Figure 1:
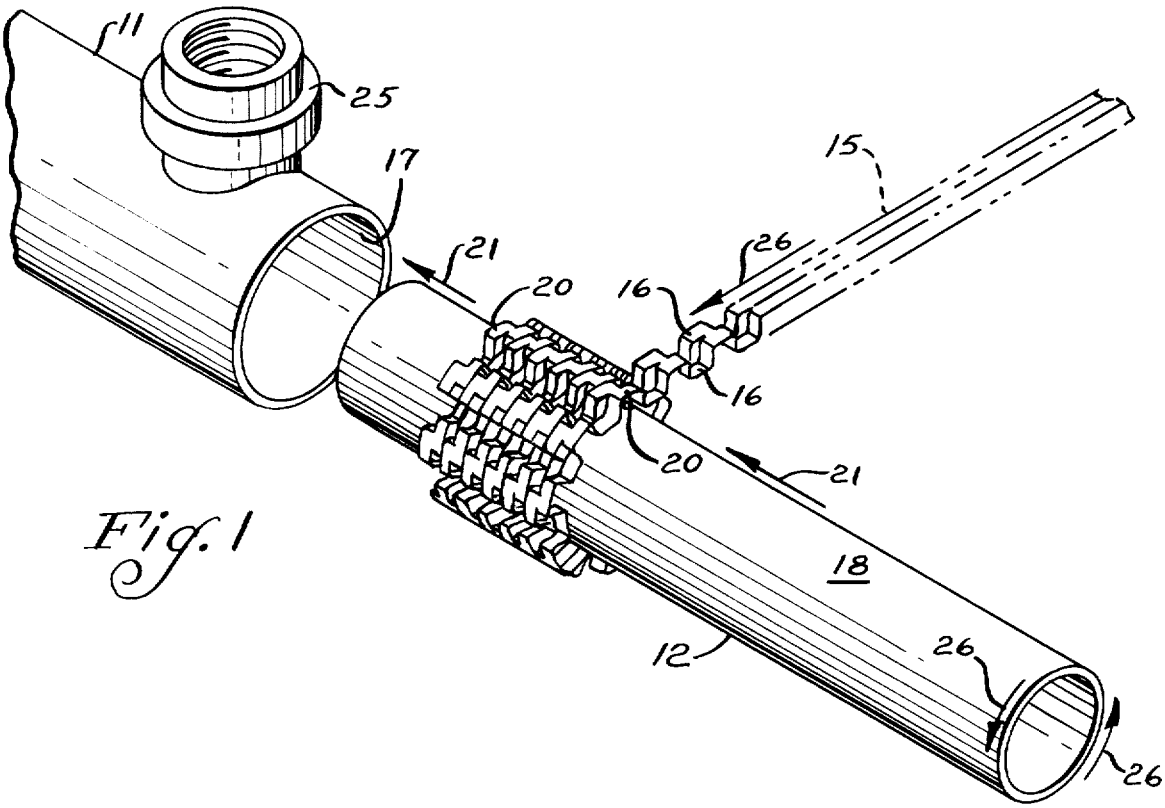
FIG. 1 is a fragmentary perspective view illustrating the method of making the heat exchanger of this invention.

In manufacturing the heat exchanger 10 of this invention the tubes 11 and 12 are arranged in separated and preferably coaxial relationship as shown in FIG. 1. Then successive coils 20 of the narrow strip 15 of turbulator are wound on the outer surface 18 of the tube 12 that becomes the inner tube and the two tubes are then telescoped together in the manner illustrated by the arrow 21 to provide the tube and turbulator arrangement of FIG. 2.

Then, the ends 22 and 23 of the tubes 12 and 13 are joined together in fluid tight relationship as shown in FIG. 2 to seal the cylindrical space 13 at each end with the turbulator coils 20 therein. After sealing the tubes may be provided with the customary fittings as illustrated at 24 and 25 at the opposite ends of the heat exchanger for connecting to pipes 26 and 27 that conduct the fluid into, through and from the turbulator containing space 13.

In the method illustrated the strip 15 of turbulator material is fed from a forming device (not shown) of the customary construction longitudinally as indicated by the arrow 26. At the same time the tube 12 which becomes the inner tube is rotated in the direction indicated by the arrows 26 and advanced in telescoping relationship as shown by the arrows 21.

Although in the illustrated embodiment successive coils 20 are in the form of a continuous contacting helix it is obvious that the successive coils could be separate and separated if desired. Thus a cutting device could be arranged to sever the coils into successive units.

The resulting heat exchanger has first inner and second outer conduits spaced apart to define a fluid space therebetween and a turbulator within the space in strip form arranged in successive coils on the outer surface of the first conduit. In the preferred embodiment the strip and thus the coils 20 are continuous although the strip could be severed to provide individual coils. Also in the illustrated embodiment the successive coils are in contact with each other.

Having described my invention as related to the embodiment shown in the accompanying drawing, it is my intention that the invention be not limited by any of the details of description, unless otherwise specified, but rather be construed broadly within its spirit and scope as set out in the appended claims.

I claim:

1. The method of making a heat exchanger having first inner and second outer conduits spaced apart to define a fluid flow space therebetween and a turbulator in said space, comprising: arranging said conduits in separated relationship with the outer surface of said first inner conduit exposed; and winding a narrow strip of said turbulator on the outer surface of said first conduit to provide successive coils of turbulator on said outer surface while simultaneously with said winding advancing the first conduit with the coils thereon longitudinally relative to said second outer conduit into the interior of said second outer conduit, said first inner and second outer conduits thereby being telescoped with said turbulator coils within said fluid flow space.

2. The method of claim 1 wherein said winding of the narrow strip is accomplished by rotating the first conduit to draw said strip longitudinally onto the first conduit outer surface, said combination of rotating of the first conduit, winding of said narrow strip and advancing of said first conduit to within the second conduit, all done simultaneously, arranges said coils of turbulator strip in adjacent contacting helical convolutions.

* * * * *